US005987799A

United States Patent [19]

Dedeaux et al.

[11] Patent Number: 5,987,799

[45] Date of Patent: Nov. 23, 1999

[54] PRIMITIVE WEAPON MUZZLE LOADER/ UNLOADER DEVICE

[76] Inventors: Tina M. Dedeaux; Edward W. Dedeaux, both of 240 Ridge Rd., Perkinston, Miss. 39573

[21] Appl. No.: 09/041,388

[22] Filed: Mar. 12, 1998

[51] Int. Cl.[6] ..... F41A 15/22

[52] U.S. Cl. ..... 42/90

[58] Field of Search ..... 42/90; 7/170

[56] References Cited

U.S. PATENT DOCUMENTS

| | | | |
|---|---|---|---|
| 17,233 | 5/1857 | Read | 42/90 |
| 921,569 | 5/1909 | Harrelson | 42/90 |
| 4,407,086 | 10/1983 | Hasselmann | 42/90 |
| 4,476,598 | 10/1984 | Beauregard | 7/170 |
| 4,536,983 | 8/1985 | Fry | 42/90 |
| 4,813,169 | 3/1989 | Calliebe | 42/90 |
| 4,817,321 | 4/1989 | Clement | 42/90 |
| 4,843,747 | 7/1989 | Echeberria | 42/90 |
| 4,875,303 | 10/1989 | DeWeert et al. | 42/90 |
| 4,974,357 | 12/1990 | Jones et al. | 42/90 |
| 5,097,615 | 3/1992 | Kearns | 42/90 |
| 5,127,179 | 7/1992 | Marsh | 42/90 |
| 5,225,614 | 7/1993 | Harchar | 42/90 |

FOREIGN PATENT DOCUMENTS 282438 9/1988 European Pat. Off. .

*Primary Examiner*—Charles T. Jordan
*Assistant Examiner*—Denise J Buckley
*Attorney, Agent, or Firm*—Richard C. Litman

[57] ABSTRACT

A muzzle-loading firearm loader/unloader device for inserting or extracting a specially designed bullet into or from the firearm's barrel. The device utilizes a spring mechanism, activated by a plunger handle, to selectively capture or release the specially designed bullet. The device permits a user to remove the bullet from the firearm without firing or marring the bullet. The device also permits a user to insert the bullet to a proper depth within the barrel.

14 Claims, 4 Drawing Sheets

PRIMITIVE WEAPON MUZZLE LOADER/ UNLOADER DEVICE

BACKGROUND OF THE INVENTION

1. Field of the Invention

The present invention relates to muzzle-loading firearms and, more specifically, to a loader/unloader device for inserting and extracting musket balls or bullets into and from a muzzle-loading firearm.

2. Description of the Related Art

A muzzle-loading firearm, as indicated by its name, is a type of firearm which is loaded through its barrel. An adequate amount of powder is first poured down the barrel into the firearm's breech. A bullet or musket ball is then inserted into the barrel and tamped down tightly on the powder. Occasionally the bullet or musket ball may become lodged in the breech of the gun. This can occur because of an inadequate powder charge, or damp powder, or for a variety of firearm malfunctions. At times, the user may simply desire to unload the firearm without firing. In any of the above scenarios the musket ball or bullet must be retrieved from the barrel.

Several devices have been proposed to facilitate the loading and unloading of muzzle-loading firearms.

U.S. Pat. No. 4,536,983 (Fry), U.S Pat. No. 4,875,303 (DeWeert et al.), U.S. Pat. No. 4,974,357 (Jones et al.), U.S Pat. No. 5,097,615 (Kearns), and European Patent 282,438 show plunger type devices for loading but disclose no means for unloading firearms of the muzzle-loading type.

U.S. Pat. No. 17,233 (Read) shows a ramrod having a chamber for holding a specifically designed musket ball. The patentee does not contemplate removing the musket ball without firing.

U.S. Pat. No. 4,407,086 (Hasselmann) and U.S. Pat. No. 5,225,614 (Harchar) disclose devices attached to ramrods for extracting musket balls from firearm barrels. In both patents a threaded member, attached to the ramrod, is screwed into the musket ball thereby marring the musket ball before the musket ball is withdrawn from the barrel.

None of the above inventions and patents, taken either singularly or in combination, is seen to describe the instant invention as claimed. Thus a firearm muzzle loader/unloader device solving the aforementioned problems is desired.

SUMMARY OF THE INVENTION

The present invention describes a device for extracting a specially designed bullet from a muzzle-loading firearm without the need for firing. The device is placed into the muzzle of the firearm in order to extract the bullet. The device utilizes a spring loaded insertion/retraction head, which is selectively movable by a plunger, to capture and extract the bullet from the firearm's muzzle. The invention also allows a user to insert the specially designed bullet to a depth within the firearm's muzzle that will ensure firm contact with a powder charge thereby greatly increasing the accuracy of the firearm.

Accordingly, it is a principal object of the invention to provide a loader/unloader-device to facilitate the extraction of a specially designed bullet from a muzzle-loading firearm without firing.

It is another object of the invention to provide a novel loader/unloader device to facilitate the insertion of a specially designed bullet into a muzzle-loading firearm.

It is a further object of the invention to provide a novel loader/unloader device for extraction of a specially designed bullet from a muzzle-loading firearm without marring the bullet.

Still another object of the invention is to provide a specially designed bullet for use with a muzzle-loading firearm.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

Detailed Description of the Preferred Embodiment

Figure 1:
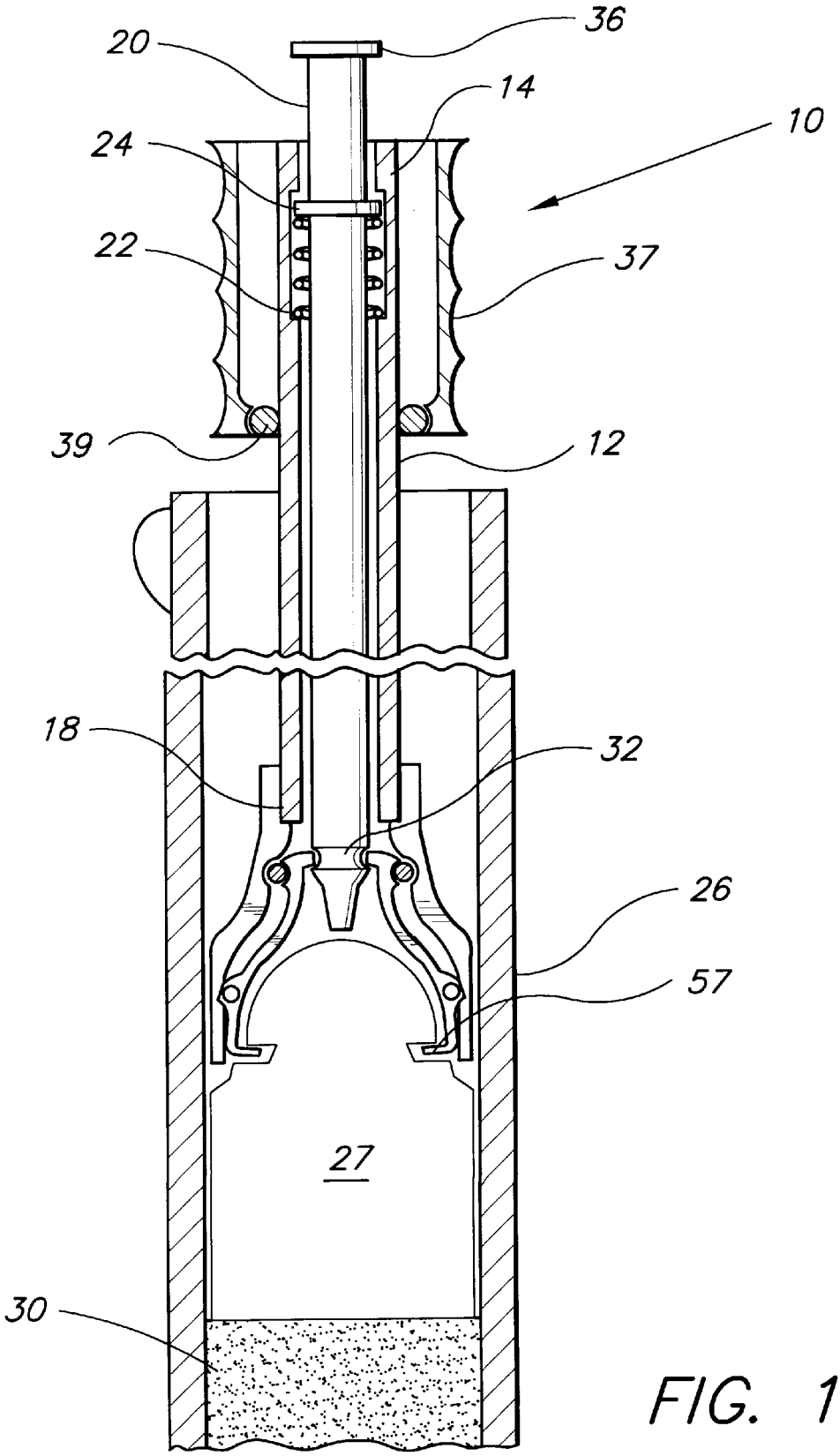
FIG. 1 is an environmental, sectional view of a firearm muzzle loader/unloader device according to the present invention with an insertion/extraction head shown in a capture position within a gun barrel.

As can be seen by reference to the drawings (FIGS. 1 and 2), a loader/unloader device of the present invention is designated generally at 10. Device 10 includes a hollow shaft 12 with a first end 14 and a second end 18. Shaft 12 may be fabricated of any rigid durable material e.g. wood, plastic, metal. A metal plunger rod 20, positioned within hollow shaft 12, extends outside of first and second ends 14 and 18. A spring 22 is seated within first end 14 and surrounds plunger rod 20. Spring 22 is retained within first end 14 by a stop member 24 attached to plunger rod 20.

Plunger rod 20 has a notched portion at 32 adjacent one end thereof. A surface 34 tapers from notched portion 32 to define the aforementioned one end of plunger rod 20. A handle member 36 defines another end of plunger rod 20. A push/pull sleeve 37 surrounds first end 14 of hollow shaft 12 and is journaled on shaft 12 at 39 to permit rotation of shaft 12 within push/pull sleeve 37.

As illustrated (FIGS. 1 and 2), device 10 is positioned within a barrel 26 of a muzzle-loading firearm. A bullet 27, positioned in barrel 26, rests upon a powder charge 30.

Figure 3:
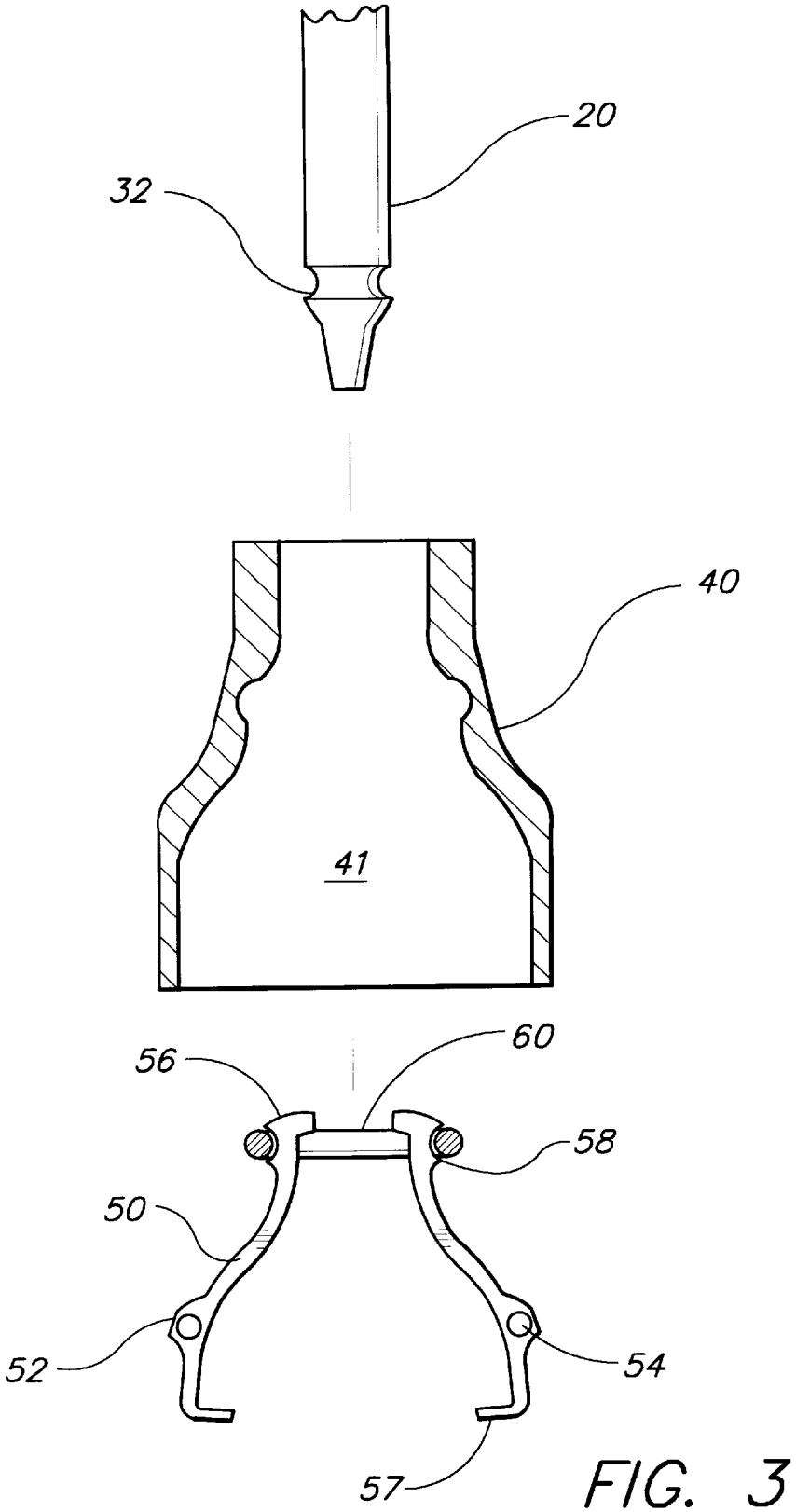
FIG. 3 is an exploded partial view of an insertion/extraction head portion in a muzzle loader/unloader device according to the present invention.
Figure 4:
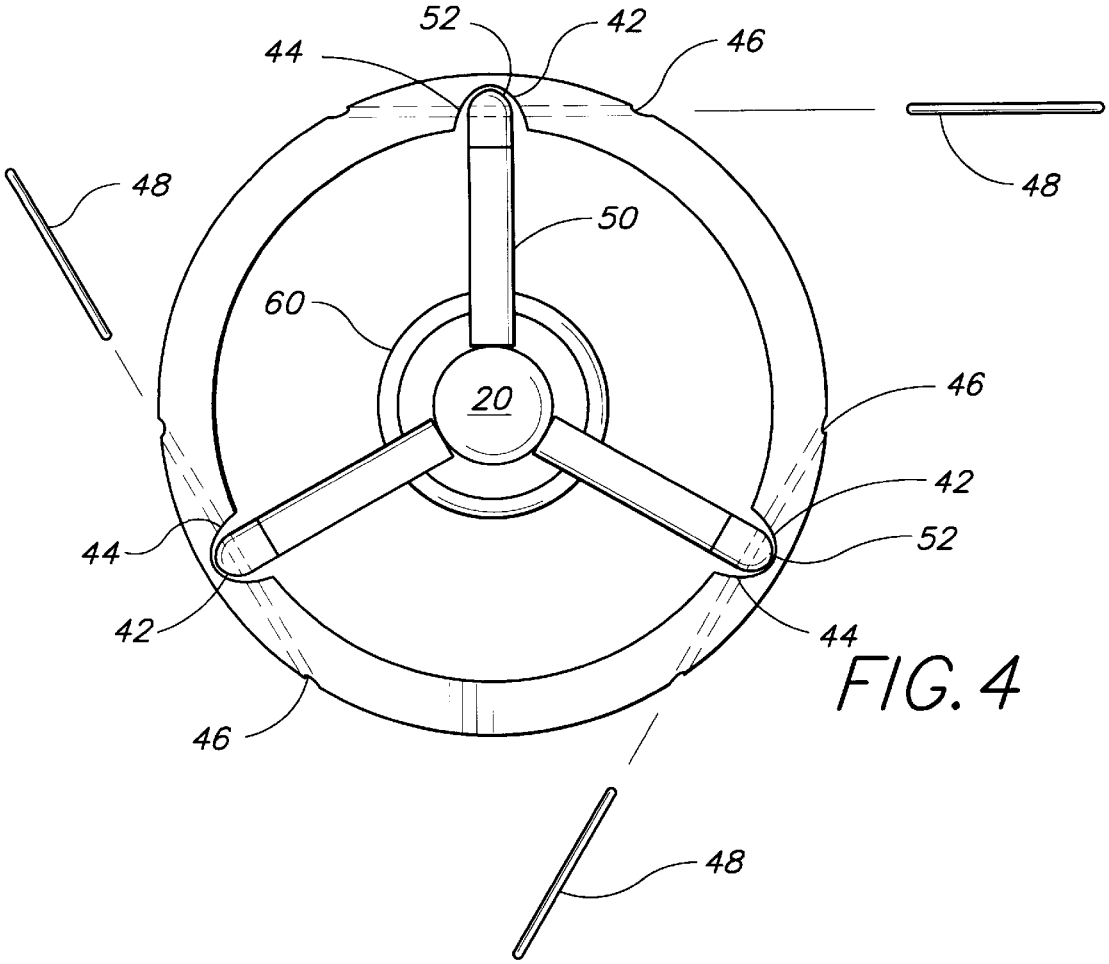
FIG. 4 is an end view in detail of the assembled insertion/extraction head portion of the present invention.

An insertion/retraction head 16, comprising a metal bell-shaped housing 40, is attached to lower end 18 of hollow shaft 12. The housing 40 has an inner surface 41 which is configured to match the contour of a specially designed bullet which will be later described. As best viewed in FIG. 4, three identical channels 42 are formed in inner surface 41 of housing 40 and are equally spaced there around. Each channel 42 has pivot holes 44 formed therein. Three pairs of apertures 46 are formed in housing 40. Each pair of apertures 46 is in axial alignment with respective channel pivot holes 44. Three identical steel spring members 50 (only two are shown in FIG. 3) are respectively received in each channel 42. Each spring member 50 has a lug 52 projecting from one side thereof. Lugs 52 have pivot holes 54 formed therein. Each spring member 50 has hook portions 56, 57 defining respective ends. Each hook portion 56, 57 projects in a direction opposite to that of lug 52. A notch 58 is formed on each spring member 50 adjacent hook portion 56.

Figure 2:
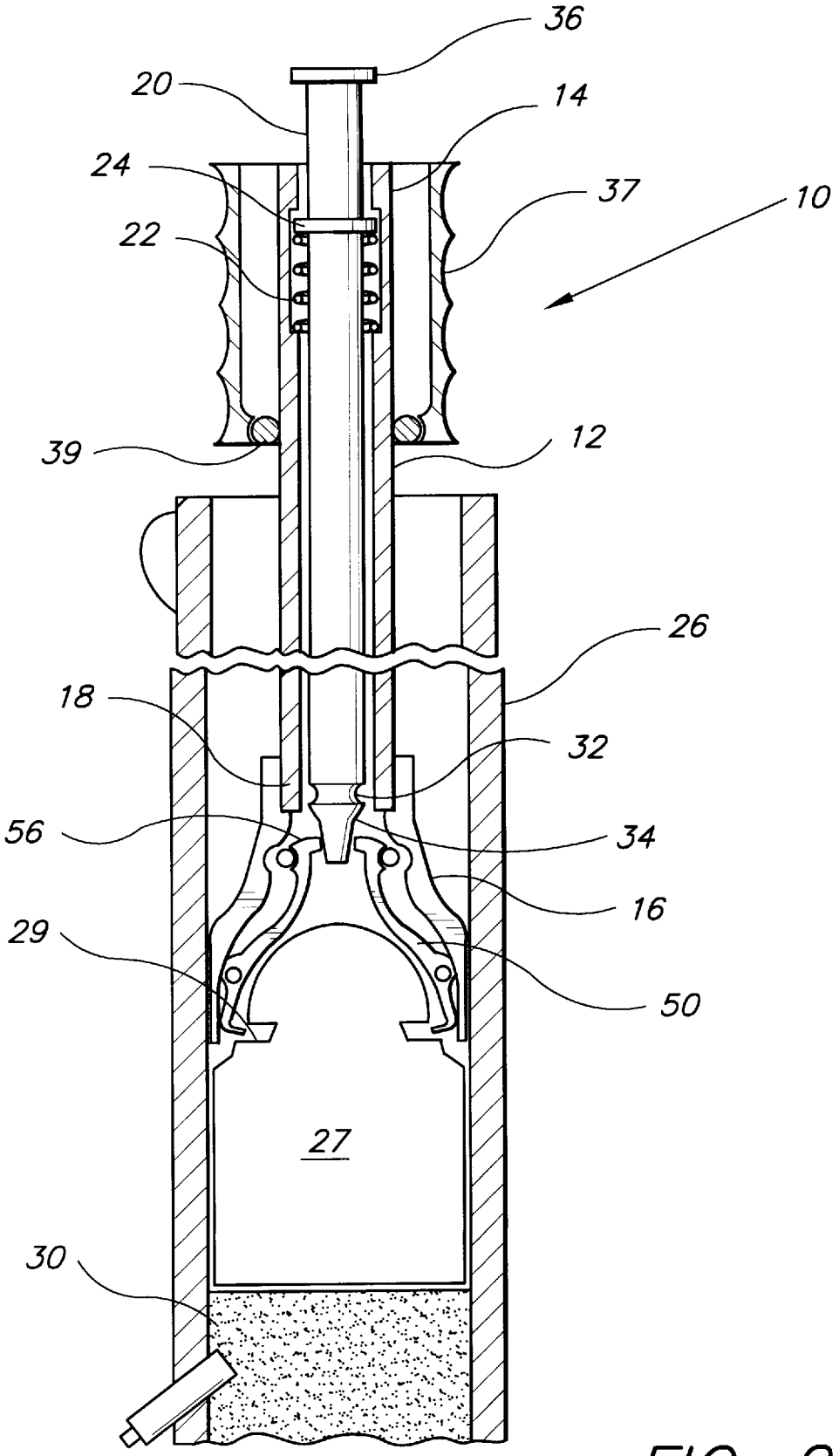
FIG. 2 is an environmental, sectional view of a firearm muzzle loader/unloader device according to the present invention with an insertion/retraction head shown in a release position.

When assembled, each spring member 50 would have a pivot hole 54 aligned with respective pivot holes 44 in channel 42. Each of three steel retainer pins 48 is inserted through a different one of apertures 46 and pivot holes 44 and 54 to pivotally secure spring members 50 in channels 42. A tension o-ring 60 or, alternatively, a metal spring is inserted into notch portion 58 of the three spring members 50 and biases the hook portions 56 of the spring members inwardly. Biasing hook portions 56 inwardly would cause the spring members 50 to pivot about retainer pins 48 thus causing the hook portions 57 of spring members 50 to move outwardly. Insertion/extraction head 16 is securely fastened to hollow shaft 12 by any known means. Plunger rod 20 is positioned in the hollow shaft 12 such that surface 34 abuts hook portions 56 as shown in FIG. 2.

Figure 5:
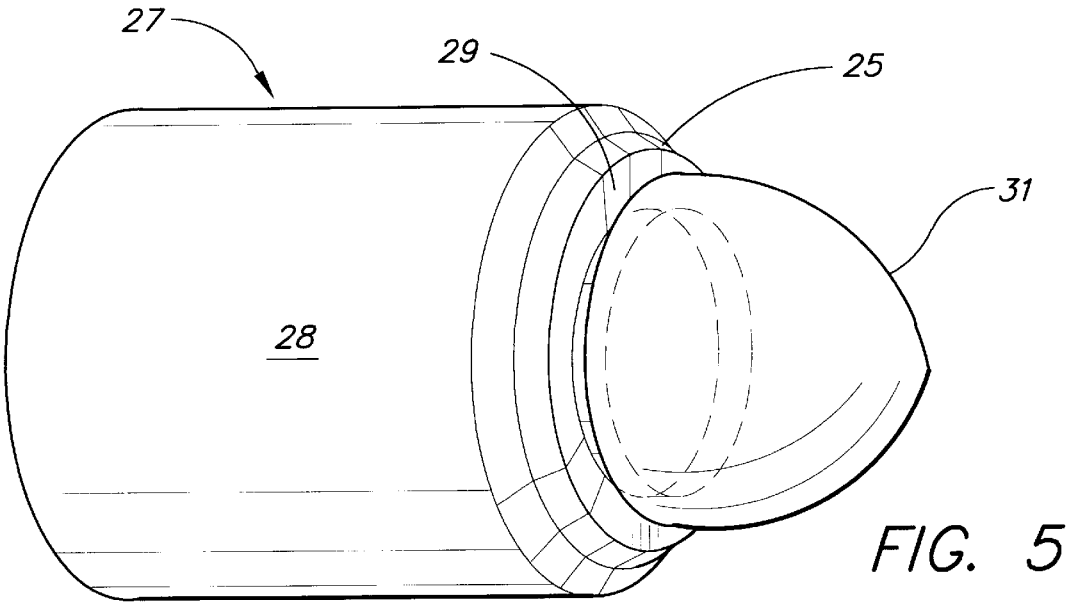
FIG. 5 is a perspective view of a bullet according to the present invention.

As best viewed in FIG. 5, a specially designed bullet 27 is adapted to be utilized with the above described loader/unloader device. Bullet 27 may be fabricated of lead with a brass coating thereon. Bullet 27 has a cylindrical body 28 and a head portion 31 shaped as a truncated elliptical solid. A groove 29 is formed around bullet 27 at a base portion 25 of head 31. Groove 29 must have a width which would accommodate hook portions 57 of spring members 50.

In operation, to extract or unload a bullet 27 from the barrel of a muzzle-loading firearm, the device 10 is inserted into the firearm's barrel. As illustrated in FIG. 2, hook portions 56 of spring members 50 would be biased inwardly by retainer 60 such that hook portions 56 would abut tapered surface 34 and hook portions 57 would be pivoted outwardly in a release position. The insertion/extraction head 16 is pushed downward until it reaches the top of bullet 27. Because housing inner surface 41 and the head portion 31 of bullet 27 have matching configurations, proper alignment is assured. Plunger rod 20 is now pushed downward causing tapered surface 34 to cam hook portions 56 outwardly and pivot the spring members on retainer pins 48. Hook portions 57 would then move inwardly into bullet groove 29 to capture the bullet. Simultaneously hook portions 56 would be positioned in notch 32 so as to lock the device in the capture position (FIG. 1).

Pulling up on push/pull sleeve 37 would allow shaft 12 to rotate as the bullet 27 is extracted. Such rotation would be caused by rifling in the firearm's barrel. When bullet 27 has been extracted from the barrel, a slight push of handle 36 causes hook portions 56 to disengage from notch 32; spring 22 biases plunger rod 20 upwardly and returns the spring members 50 to the release position, thus freeing the bullet.

To insert or load a bullet into a muzzle-loading firearm, the procedure as set out in the above paragraph would be reversed. First, plunger rod 20 would be pushed downward to allow spring members to capture bullet 27. The device 10 would then be inserted into the firearm's barrel. Rifling in the barrel would cause bullet 27 and shaft 12 to rotate as the push/pull sleeve 37 is pushed downward. When the bullet has reached the required depth, firmly positioned on powder charge 30, device 10 is allowed to return to the release position and is withdrawn from the firearm's barrel.

The dimensions of the loader/unloader device and bullet may be varied such that the present invention is adaptable to any size and type of muzzle-loading firearm.

It is to be understood that the present invention is not limited to the embodiment described above, but encompasses any and all embodiments within the scope of the following claims.

We claim:

1. A firearm muzzle loader/unloader device comprising:

a hollow shaft having a first end and a second end;

a rod positioned in said hollow shaft and in axial alignment therewith, said rod having one end extending from said hollow shaft first end and an other end extending from said hollow shaft second end;

a coil spring seated within said hollow shaft adjacent said first end and concentric with said rod;

stop means fixed on said rod and confining said coil spring within said hollow shaft first end;

an insertion/retraction head fixed to said hollow shaft second end;

a push/pull sleeve concentric with said hollow shaft first end and spaced outwardly therefrom, said hollow shaft journaled to said push/pull sleeve for rotation therein.

2. A loader/unloader device as defined in claim 1 wherein said one end of said rod has a handle affixed thereon and said other end of said rod is formed as a tapering surface.

3. A loader/unloader device as defined in claim 2 wherein a notch is formed around said rod adjacent said tapering surface.

4. A loader/unloader device as defined in claim 3 wherein said insertion/retraction head comprises a bell-shaped housing having an open top and an open bottom axially aligned with said hollow shaft and wherein said other end of said rod extends into said open top.

5. A loader/unloader device as defined in claim 4 wherein said bell-shaped housing has an inner surface and wherein spring members are pivotably mounted and evenly spaced around said inner surface.

6. A loader/unloader device as defined in claim 5 wherein first and second hook means are formed on said spring members and wherein said tapering surface of said rod is in abutting relationship with said first hook means.

7. A loader/unloader device as defined in claim 6 wherein said notch is formed on each said spring members, said notch positioned adjacent said first hook means.

8. A loader/unloader device as defined in claim 7 including an elastic o-ring positioned in said notch.

9. A loader/unloader device as defined in claim 8 wherein said second hook means formed on said spring members are adapted to engage and capture a bullet.

10. A loader/unloader device as defined in claim 9 further including a bullet having a cylindrical body and a head shaped as a truncated elliptical solid with a base and wherein a groove is formed around said bullet head base.

11. A loader/unloader device as defined in claim 10 said bullet head and said housing inner surface have matching configurations.

12. A loader/unloader device as defined in claim 11 wherein said second hook means are dimensioned and configured to engage and capture said bullet in said groove.

13. A firearm muzzle loader/unloader device comprising:

a hollow shaft having a first end and a second end;

a rod positioned in said hollow shaft in axial alignment therewith, said rod having one end extending from said first end of said hollow shaft and an other end extending from said second end of said hollow shaft wherein said other end is formed as a tapering surface and a notch is formed on said rod adjacent said tapering surface;

a coil spring seated within said hollow shaft adjacent said first end, said coil spring concentric with said rod;

stop means fixed on said rod and confining said coil spring within said hollow shaft first end;

a bell-shaped housing having an open top and an open bottom axially aligned with said hollow shaft, said bell-shaped housing fixed to said second end of said hollow shaft;

spring members evenly spaced and pivotably mounted on an inner surface of said bell-shaped housing, said spring members having first and second hook means formed thereon and wherein said tapering surface of said rod is positioned to abut said first hook means;

biasing means positioned on said spring members for biasing said first hook means in an inward direction while biasing said second hook means in an outward direction; and a sleeve member concentric with said hollow shaft first end and spaced outwardly therefrom, said hollow shaft journaled to said sleeve member for rotation therein.

14. A loader/unloader device as defined in claim 13 wherein said second hook means formed on said spring members is adapted to engage and capture a bullet.

* * * * *